United States Patent [19]

Johnston

[11] Patent Number: 4,878,591

[45] Date of Patent: Nov. 7, 1989

[54] SHOCK RESISTANT CELLULAR FUEL TANK

[76] Inventor: Daniel D. Johnston, 355 "I" Ave., Coronado, Calif. 92118

[21] Appl. No.: 215,040

[22] Filed: Jul. 5, 1988

[51] Int. Cl.[4] ..... B65D 1/24

[52] U.S. Cl. ..... 220/22; 220/88 R; 220/900

[58] Field of Search ..... 220/22, 88 R, 900, 21

[56] References Cited

U.S. PATENT DOCUMENTS

| | | | |
|---|---|---|---|
| 2,439,562 | 4/1948 | Cunningham | 220/900 |
| 2,850,083 | 9/1958 | Frost | 220/85 R |
| 3,764,035 | 10/1973 | Silverman | 220/85 R |
| 4,248,342 | 2/1981 | King et al. | 220/85 R |

*Primary Examiner*—A. Michael Chambers

*Attorney, Agent, or Firm*—Baker, Maxham, Jester & Meador

[57] ABSTRACT

A shock resistant fuel tank comprises a plurality of cylindrical cells supported within a frame over which an impervious enclosing shell is stretched.

18 Claims, 1 Drawing Sheet

FIG. 1
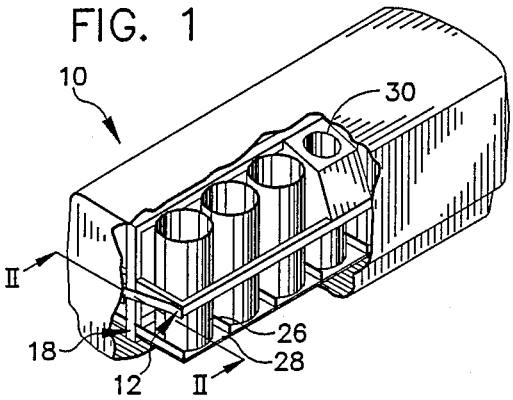
FIG. 2
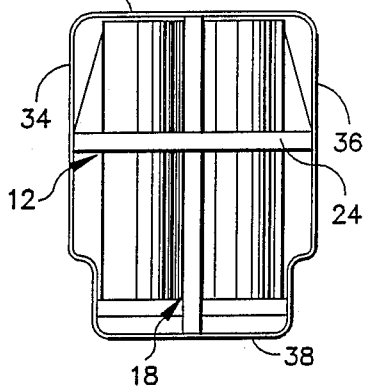
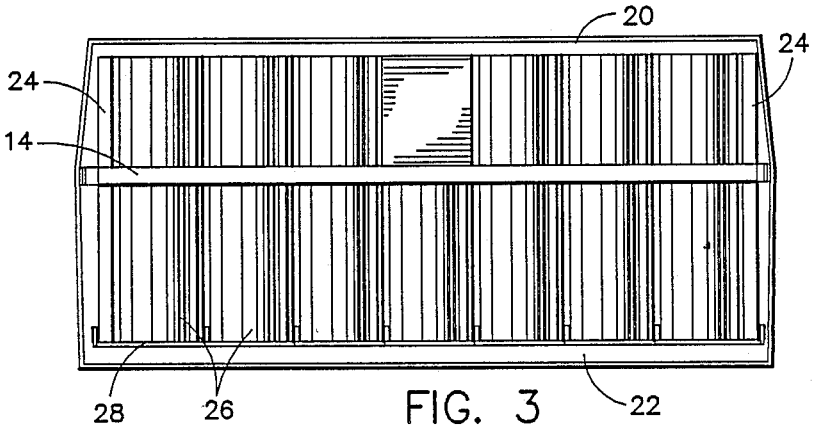
FIG. 3
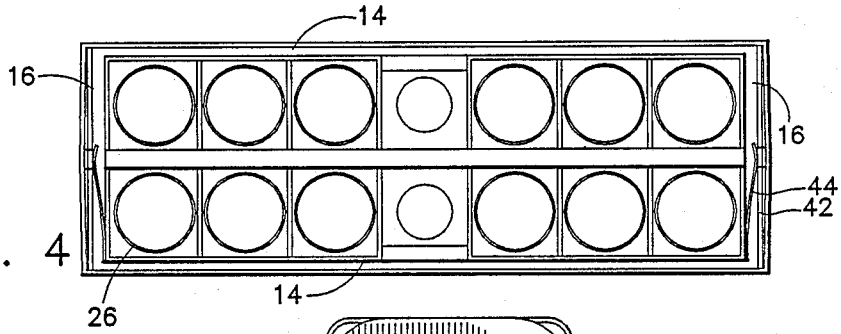
FIG. 4
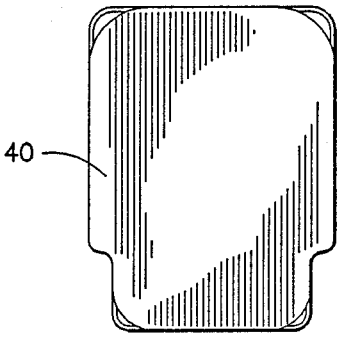
FIG. 5

SHOCK RESISTANT CELLULAR FUEL TANK

BACKGROUND OF THE INVENTION

The present invention relates to fuel tanks and pertains particularly to shock resistant cellular fuel tanks.

High speed ocean going racing boats undergo heavy shock loads as they hit waves. These shock loads are transmitted to structures throughout the vessel, including fuel tanks. Present fuel tanks used on most high speed boats have baffles welded into the tank to aid in reducing the shock loads by and on the fuel. The present tanks have a life of about thirty hours.

It is desirable that shock resistant long lasting fuel tanks be available for high speed ocean going vessels.

SUMMARY AND OBJECTS OF THE INVENTION

It is the primary object of the present invention to provide an improved shock resistant fuel tank.

In accordance with a primary aspect of the present invention, a fuel tank comprises an array of cells mounted on a frame with an impervious shell stressed in tension over the frame and cells.

BRIEF DESCRIPTION OF THE DRAWING

The above and other objects of the present invention will become apparent from the following description when read in conjunction with the accompanying drawings wherein:

FIG. 1 is a perspective view with portions broken away to reveal details of the invention;

FIG. 2 is a section view taken on line II—II of FIG. 1;

FIG. 3 is a section view taken on line III—III of FIG. 1;

FIG. 4 is a section view taken on line IV—IV of FIG. 1; and

FIG. 5 is an end view of the embodiment of FIG. 1.

DETAILED DESCRIPTION OF A PREFERRED EMBODIMENT

The present invention is directed to cellular fuel tanks for resisting high shock loads for use, for example, in high speed racing boats, such as shown in my prior U.S. Pat. No. 4,744,320, granted May 17, 1988. Referring to FIG. 1 of the drawings, an exemplary embodiment of a fuel tank in accordance with the invention is illustrated. As illustrated in FIG. 1, the fuel tank generally comprises a plurality of vertically oriented tubular cells supported within a peripheral framework and enclosed within an impervious shell that is stressed around the framework.

The fuel tank system, in accordance with the invention, comprises particularly a framework of cross peripheral, generally rectangular frames comprising a first generally horizontal rectangular frame 12, which comprises a pair of side members 14 connected together at the ends thereof by a pair of cross end members 16, as shown in FIGS. 2 and 4. A centrally positioned vertical frame, designated generally by the numeral 18, comprises upper and lower elongated frame members 20 and 22 connected together by vertical end members 24. The vertical end members cross the horizontal cross member 16 of the horizontal frame and are secured thereto.

A plurality of cell members, which in the illustrated embodiment comprises a plurality of vertically oriented cylindrical tubular members 26, are mounted in two rows or a pair of rows to each side of the central frame member 18 and secured thereto. These cell members 26 are surrounded by the horizontal peripheral frame 12 and are secured thereto.

The vertical cylindrical cell members 26 are supported at their lower end in a plurality of identical cross trays 28, which are mounted on the bottom longitudinal frame member of the peripheral frame 18. These trays with short upwardly extending side walls and open ends receive and support the lower ends of the tubular cell members 26. As can be clearly seen in FIGS. 3 and 4, the peripheral frames 12 and 18 have a peripheral dimension that extends beyond the outer dimension of the cell members. The central frame 18 has a height exceeding that the of the cell members, and the horizontal frame 12 extends outside the outermost dimension of the array of cell members.

A center cell member in each of the rows of the illustrated embodiment is covered by a generally rectangular or box-like housing cover 28 having a circular opening 30 in the top thereof. This box-like enclosure extends from the uppermost edge of the central frame assembly 18, down to and extends outward to the outermost edge of the horizontal frame assembly 12. This unit is centered in the center of the length of the array cells. The tubular cells may have any configuration but are preferably cylindrical.

The vertical frame member is preferably constructed of T-bar members, whereas the horizontal frame member may be formed of T-bar members, box-beam members or L-members.

The outer skin or shell of the tank unit is constructed of a high strength sheet metal, such as aluminum sheeting and is formed with rounded corners, with welding away from the corners. The welding seams are spaced from and extend along adjacent the rounded corners. In the method of construction, the shell if formed of a tubular configuration, and the cell array supported or mounted in the frame assembly is forced into the open ended shell, forcing the walls of the shell to elastically stress and stretch over the frame assembly, thus enclosing the cells.

An initial series of prototypes of the present invention was constructed in this manner, with the cell array pulled into the preformed open ended shell by means of a come along arrangement supported against one end of the shell by an A-frame support, with legs engaging the ends of the shell. An assembly of rollers were positioned at the forward edge of the corners of the frame and positioned to engage the shell prior to engagement by the frame members, and to force the walls of the shell outward to enable the frames to slide into the shell. The frame members were lubricated to facilitate ease of assembly.

Once the cell assembly is positioned within the open ended shell, the ends 40 of the shell are selected and secured in place.

Referring to FIG. 5, an end cover 40 having the general configuration of the cross-section of the shell is formed with a dished end, with the center thereof bulging outward in a somewhat shallow pyramid configuration. The corners of the ends are cut off to leave a gap between the corners thereof and the corners of the shell. The end caps 40 are each provided with a wear plate 42, against which a leaf spring 44 secured at the ends of the frame to the horizontal end members 24 engage. As shown in FIG. 4, this provides a pre-loading on both ends of the frame unit. The cells within the framework and within the shell are thus pre-loaded against both ends of the shell. The shell is thus essentially stressed over the framework of cells.

In assembly of the ends to the shell, they are placed in position and are then welded in place by auto feed wire welding, leaving openings at the corners thereof. The corners are then heliarc welded to complete the assembly. This provides a high strength shock resistant tank assembly which is able to withstand high shock loads for a long duration of time. With this arrangement, the shock loads are distributed around the entire array of cells and supported by the rigid framework pre-loaded within the shell. The fuel is distributed around among the many cells therein. Openings into the tank are preferably formed in the rounded portion of the corners. These openings (not shown) for filling and drawing fuel from the tank are of conventional construction and configuration.

In the preferred form, the fuel tank is constructed of aluminum for maximum strength to weight. However, the fuel cell may be constructed of any other suitable sheet material such as stainless steel or the like.

While I have illustrated and described my invention by means of specific embodiments, it is to be understood that numerous changes and modifications may be made therein without departing from the spirit and scope of the invention as defined in the appended claims.

I claim:

1. A shock resistant cellular fuel tank comprising:

a peripheral frame having longitudinally extending top, bottom and opposed side members;

an array of vertically oriented tubular cells mounted to and within said peripheral frame; and an impervious shell preloaded and stressed in tension over said frame for restraining movement of said frame within said shell and enclosing said cells.

2. A fuel tank according to claim 1 further comprising:

a plurality of trays supported on said bottom member; and said cells are mounted in said trays.

3. A fuel tank according to claim 1 wherein:

said shell is stressed on opposite sides thereof by said frame, and is stressed on opposite ends by means of a wear plate and a leaf spring.

4. A fuel tank according to claim 1 wherein:

said cells are cylindrical in configuration.

5. A fuel tank according to claim 4 wherein:

said cells are oriented in a common direction.

6. A fuel tank according to claim 1 wherein:

all corners of said shell are rounded.

7. A fuel tank according to claim 1 wherein:

said shell is generally rectangular in cross-sectional configuration.

8. A shock resistant cellular fuel tank comprising in combination:

a first generally horizontal rectangular peripheral frame defined by a pair of laterally spaced elongated longitudinally extending side members connected together by a pair of horizontal end members;

a second generally vertical rectangular peripheral frame defined by a pair of vertically spaced elongated longitudinally extending top and bottom members connected together by a pair of vertical end members;

an array of elongated tubular cells oriented in a common direction and mounted to and within said peripheral frame; and an impervious sheet metal shell stretched in tension over said frame for restraining movement of said frame within said shell and enclosing said cells.

9. A fuel tank according to claim 8 wherein:

said cells are cylindrical in configuration.

10. A fuel tank according to claim 9 wherein:

said shell is stressed on all sides by said frame; and said shell is stressed at opposite ends thereof by spring means disposed between said peripheral frame and opposite ends of said shell.

11. A fuel tank according to claim 10 wherein:

said cells are vertically oriented.

12. A fuel tank according to claim 11 wherein:

all corners of said shell are rounded.

13. A fuel tank according to claim 12 wherein:

said shell is generally rectangular in cross-sectional configuration.

14. A shock resistant cellular fuel tank comprising in combination:

a first generally horizontal rectangular peripheral frame defined by a pair of laterally spaced elongated longitudinally extending side members connected together by a pair of horizontal end members;

a second generally vertical rectangular peripheral frame defined by a pair of vertically spaced elongated longitudinally extending top and bottom members connected together by a pair of vertical end members, said first and second frames being connected together proximate the center of said end members;

an array of elongated cylindrical tubular cells oriented in a common vertical direction and mounted to and within said peripheral frames; and an impervious sheet metal shell stretched and stressed in tension over said frame for restraining movement of said frame within said shell and enclosing said cells.

15. A fuel tank according to claim 14 wherein:

a plurality of trays supported on said bottom member; and said cells are mounted in said trays.

16. A fuel tank according to claim 15 wherein:

said shell is stressed on all sides; and spring biased at the ends thereof.

17. A fuel tank according to claim 15 wherein:

said cells are disposed in a pair of generally parallel rows.

18. A fuel tank according to claim 14 wherein:

said shell is of and elongated generally rectangular box-like configuration of a welded aluminum construction, and the ends thereof are slightly dished.

* * * * *